United States Patent [19]

Anthony, Jr. et al.

[11] 4,083,528

[45] Apr. 11, 1978

[54] METALLURGICAL SIDEBOARD OR HOT TOP SUSPENSION SYSTEM

[76] Inventors: Carl Anthony, Jr., 855 Mill St.; Donald E. Wiley, 537 Underridge Rd., both of Conneaut, Ohio 44030

[21] Appl. No.: 708,777

[22] Filed: Jul. 26, 1976

[51] Int. Cl.[2] ..... B22D 7/10

[52] U.S. Cl. ..... 249/198

[58] Field of Search ..... 249/106, 197, 198, 202

[56] References Cited

U.S. PATENT DOCUMENTS 3,202,395 8/1965 Beattie ..... 249/202

FOREIGN PATENT DOCUMENTS 1,261,633 2/1968 Germany ..... 249/202

*Primary Examiner*—Robert D. Baldwin

*Attorney, Agent, or Firm*—James C. Simmons; E. Eugene Innis; Barry Moyerman

[57] ABSTRACT

A suspension system for a metallurgical article such as a sideboard or hot top used to control solidification of molten metal in an ingot mold. The hanging device is partially embedded in the article and cooperates with slotted apertures in the article to support it against the ingot mold wall. The slotted apertures are arranged so that in combination with a cooperating hanger the article can be positioned at different depths within the mold. A further feature of the invention resides in the shape and location of the hanger so that during shipment, the hanger lies in essentially the plane defined by that portion of the article in which it is embedded.

10 Claims, 5 Drawing Figures

METALLURGICAL SIDEBOARD OR HOT TOP SUSPENSION SYSTEM

BACKGROUND OF THE INVENTION

1. Field of the Invention

This invention pertains to suspension systems for metallurgical articles (sideboards or hot tops) used at the top of an ingot mold to control solidification of the molten metal in the ingot mold.

In its broadest aspects, the Invention encompasses sideboards, the so-called monolithic hot tops and riser sleeves which are supported in a mold which receives molten metal.

In particular, the invention will be described in relation to sideboards used in molds which are commonly found in the steel mill. Sideboards are generally flat panels placed in the top of the ingot mold and can show insulating refractory or exothermic properties. The sideboards can be used in pairs or in fours to form a completely enclosed reservoir at the top of the ingot mold.

2. Description of the Prior Art

A conventional monolithic hot top and one suspension system therefor is illustrated in U.S. Pat. No. 1,794,840.

As an alternative to the monolithic hot top over the years, there have been various types of hot tops employing flat pieces (boards) of refractory or exothermic material which are assembled inside of the ingot mold. Illustrative of this type of composite hot top are the devices shown in U.S. Pat. Nos. 1,137,264; 1,501,655; 2,546,270; 3,165,798; and 3,202,395.

Another type of heat control product, and one that is used extensively with the so-called slab type ingot (one which has an elongated rectangular cross-section), is the sideboard illustrated in U.S. Pat. Nos. 3,103,045 and 3,144,698. The sideboards can be used in groups of four to achieve a hot top or closed reservoir as illustrated in U.S. Pat. No. 3,421,731.

When using a sideboard, the board must be supported against the wall of the ingot mold. The board must be held tightly to the ingot mold so that no metal flows between the board and the mold wall to chill against the mold wall thus depleating the reservoir of molten metal which feeds the balance of the ingot as it solidifies. The object of the sideboard is to control the temperature of the molten metal at the top of the ingot mold so that it solidifies less rapidly than the rest of the ingot mold and feeds additional metal to the major portion of the ingot mold as it solidifies.

All of the foregoing patents drawn to metallurgical sideboards and hot tops, illustrate various ways of fastening the board or the top to the ingot mold. Most commonly used are the clip type fasteners which are illustrated by U.S. Pat. Nos. 3,144,698 and 3,506,236.

Another type of hanger is the support hanger illustrated in U.S. Pat. Nos. 3,165,798 and 3,202,395. The hanger type, is as the name implies, a hanger which is supported by the top surface of the ingot mold. The hanger itself is either fastened to the hot top panels (U.S. Pat. No. 3,202,395) or communicates with an aperture in the hot top panels (U.S. Pat. No. 3,165,798).

SUMMARY OF THE INVENTION

The present invention concerns itself with an improved hanger type system for supporting a metallurgical sideboard or hot top.

The present invention consists of a sideboard or each wall of a hot top having at least two generally parallel, spaced apart apertures which extend from one face of the board (each wall of a hot top) through to the other face. Between these two apertures is a passage extending generally perpendicular to the apertures and opening only on the face (each wall of the hot top) of the sideboard (hot top) that will contact the mold wall. Imbedded within the sideboard (each hot top wall) is a hanger rod which rod extends the length of the passage between the apertures and has a hook-like protrusion on either end to support the board (hot top) in the aperture and the hanger on the top surface of the ingot mold. The hanger device is constructed so that during the manufacture, packaging and shipping, the board (each wall of the hot top) and hanger lie in a plane defined essentially by the faces (walls) of the sideboard (hot top). In use, the hanger is rotated to support the board (hot top), and in turn, be supported by the top surface of the ingot mold. By selecting the spacing of the apertures, the hanger can be moved to cooperate with a preselected aperture and thus, the user can position the sideboard (hot top) at varying depths from the top of the ingot mold. This feature is desirable in view of differing teeming practices associated with different grades of metal which are cast into ingot form from the primary melting furnace.

Therefore, it is the primary objective of this invention to provide an improved sideboard and hot top suspension system.

It is another object of this invention to provide a suspension system for a metallurgical article which suspension system is an integral part of the article.

It is yet another object of this invention to provide a combined metallurgical sideboard and suspension device wherein the manufacture and shipping of the combined apparatus is facilitated.

It is a further object of this invention to provide a combined metallurgical sideboard or hot top and suspension system wherein the suspension system can be adjusted to position the sideboard or hot top at varying depths from the top of the ingot mold.

DETAILED DESCRIPTION OF THE INVENTION

As set out above, the suspension system of the present invention can be used with monolithic hot tops as well as sideboards. However, for illustrative purposes only, in the following description only a sideboard is identified as the metallurgical article employing the suspension system of the present invention.

Figure 1:
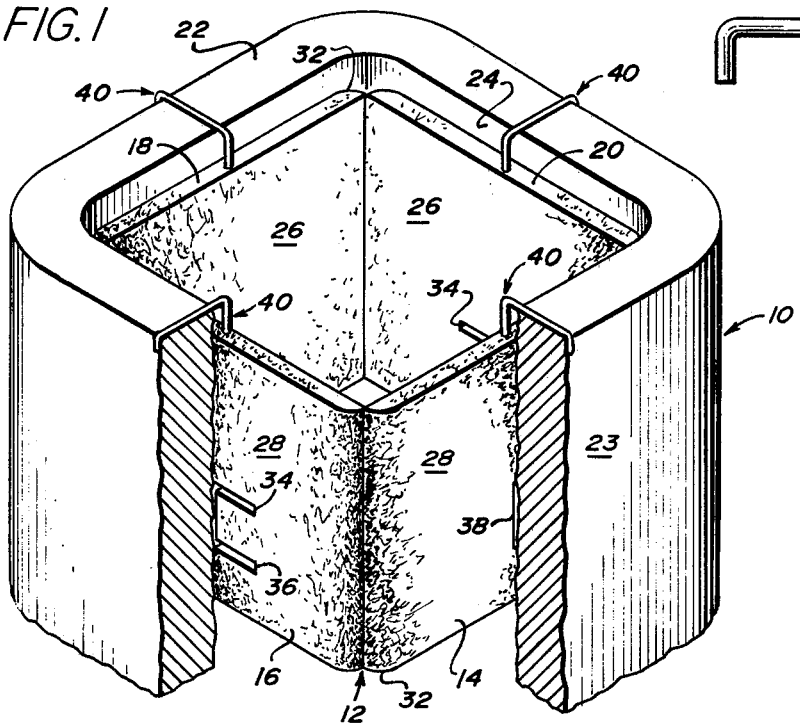
FIG. 1 is an isometric view with portions broken away showing sideboards according to the invention in place against the inner wall of an ingot mold.

Referring to the drawing, and in particular FIG. 1, there is shown an ingot mold 10, generally fabricated from cast iron or steel. The ingot mold 10 receives molten metal from the furnace and holds the metal until it solidifies into the ingot shape which is then removed from the mold and processed to intermediate or final shape by rolling, forging, extruding, or the like.

In casting certain metals, and in particular ferrous metals, because of the size of the ingot and the nature of the solidification process of the ingot, it is desirable to keep the upper portion of the ingot molten so that metal is continuously fed to the balance of the ingot as it solidifies. This increases the usable amount of metal in the finished ingot. One way of achieving this control of solidification is to include a hot top in the ingot mold. The hot top defines a reservoir which receives the last charge of molten metal, and because of the nature of the reservoir, maintains the metal in a molten condition. The hot top can be manufactured from insulating material such as synthetic or natural fibers thus slowing the rate of solidification by slowing heat loss through the ingot mold wall. Alternatively, the hot top can be made of an exothermic material which burns and liberates heat to make it possible to have a slower rate of solidification of the molten metal at the top of the ingot mold.

There is shown in FIG. 1 a hot top reservoir 12 placed inside of ingot mold 10, which is fabricated from four sideboards (boards) 14, 16, 18 and 20. The boards (panels) 14, 16, 18 and 20 are shaped so that they fit snuggly inside of the top of the mold and define a complete reservoir so molten metal does not leak between the boards and attack the exposed ingot mold wall.

The hot top 12 can be positioned flush with the top 22 of the ingot mold 10, or it can be positioned at various depths within the ingot mold, as illustrated in FIG. 1 by the exposed portion of the inner wall 24 of the ingot mold 10. The position of the hot top 12 will be determined by the user taking into consideration such factors as the grade of metal being cast into the mold, the particular melting method, and practice in the particular melt shop.

In addition to the fully enclosed hot top reservoir, as shown in FIG. 1, is is common practice to cast molten metal (especially steel) in ingot molds having a cross-section of an elongated rectangle. In casting steel into these type ingots, sometimes because of the dimensions of the ingot, it is only necessary to place sideboards on opposite sides of the ingot mold (i.e. panels 14, 18). These types of molds then only require a hanger to hold the board against the mold wall. U.S. Pat. No. 3,148,421 is illustrative of sideboard practice in a slab type ingot mold.

Figure 4:
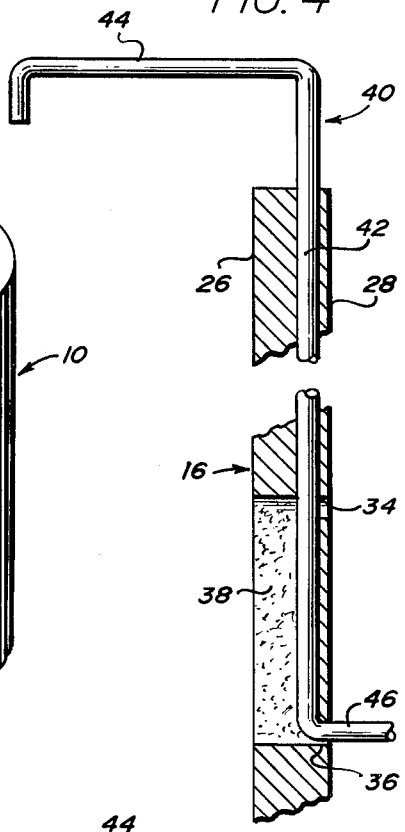
FIG. 4 is an enlarged fragmentary section taken along the lines 4—4 of FIG. 2.
Figure 2:
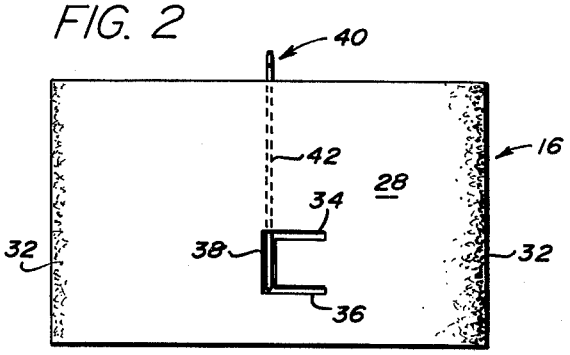
FIG. 2 is a front elevational view of a sideboard according to the instant invention.
Figure 3:
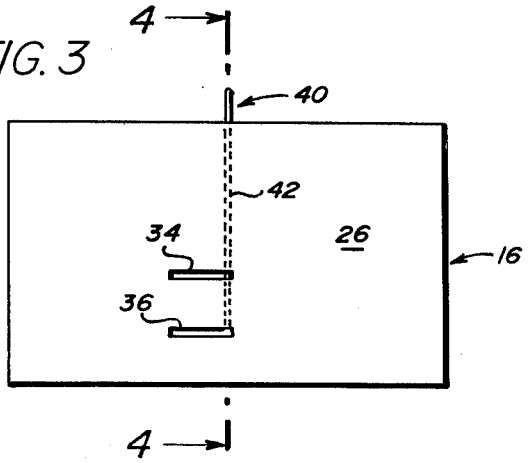
FIG. 3 is a rear elevational view of a sideboard according to the present invention.

The boards of the present invention (14, 16, 18, 20) are further illustrated in FIGS. 2–4, by a detailed drawing of board 16. However, boards 14, 18 and 20 are identical to board 16. Board 16 contains a front face 26 having a generally rectangular shape. It should be understood that the board is generally a parallelepiped and the faces can be rectangular, square, or trapezoidal in shape depending upon the ingot mold with which it is to be used. Referring to FIG. 3, board 16 has a reverse face 28 which is generally parallel to face 26 and contains rounded ends 30 and 32. Ends 30 and 32 are included to facilitate a close fitting of board 16 with its neighbors (14, 18) in the ingot mold 10 to prevent molten metal intruding at the joint line btween adjacent boards.

Board 16 includes a pair of slotted apertures 34 and 36, each of which extends completely through face 26 to face 28 of board 16. Extending between apertures 34 and 36 generally normal thereto, is a passage 38. Passage 38 communicates with face 28 of board 16, but does not open onto face 26 of board 16.

Molded within board 16 is a hanger generally designated as 40. Hanger 40 has a first section 42 which is rotatably mounted within the board 16 in such a fashion so that a portion of section 42 is disposed in passage 38. The hanger projects from the top of board 16 and terminates in a second, or hook-like section 44. The hook-like section 44 is adapted to engage the top surface 22 of the ingot mold and hold board 16 adjacent to the inner wall of ingot mold 10. At the opposite end of first section 42 of hanger 40, is a third section or leg 46 disposed generally at a right angle to section 42 of hanger 40. Section 46 is of a length which is no longer than the length of slotted apertures 34 and 36.

Figure 5:
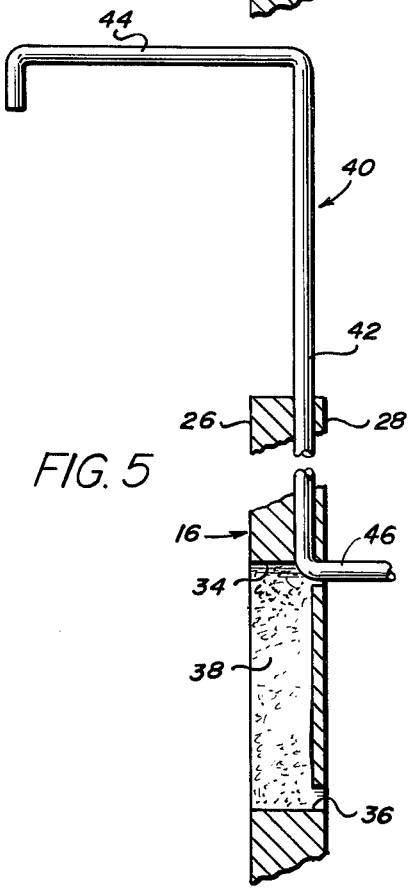
FIG. 5 is an enlarged fragmentary view similar to FIG. 4 showing the hanger in an alternate position.

As shown in FIG. 4, hanger 40 is disposed within board 16 so that the third section 46 can project through slot 36. Should the user decide to lower the position of board 16 within the ingot mold, hanger 40 can be rotated 180° so that third section 46 is free to move vertically within passage 38. The hanger 40 is then raised to the upper position as shown in FIG. 5, and the hanger 40 rotated another 180° so that the lower section (leg) 46 contacts passage 34 to hold the board 16 at a lower position in the ingot mold.

Hanger 40 is fabricated so that sections 44 and 46 lie in a common plane passing through section 42 of hanger 40. Thus, when the board is molded, hanger 40 can be placed in a mold containing projections to provide apertures 34, 36 and passage 38 in the finished board 16 in the same plane that is defined by faces 26 and 28 of the molded board 16, thus a simple mold can be used to fabricate the the board 16 with the hanger 40 in place.

In view of the fact that hanger 40 is rotatable so that it can be made to be in the position within the plane defined by faces 26 and 28 because of the geometry of apertures 34 and 36, the boards are readily packaged for shipment. The thinness of the board facilitates packaging of a great many boards in a small volume. This same disposition of the hanger 40 facilitates shipment since more boards can be shipped in a given volume of space. In point of fact, boards can be displaced vertically within cartons without having undue breakage in transit.

In view of the foregoing disclosure, it would become apparent to a worker skilled in the art that, in addition to apertures 34 and 36, additional apertures could be disposed parallel to, and above or below these apertures, to enable the user to adjust the position of the board within the ingot mold to accommodate other melting and casting practices.

Similarly, if an elongated board was fabricated for use in a slab type ingot, the hanging system, according to the present invention, could be employed wherein several hangers are used with one board.

It is contemplated that the system of the present invention could be used with a monolithic hot top system, employing a hanger and apertures in each wall of the hot top.

The system can be used with hot tops or sideboards that are refractory, insulating or exothermic in nature. The properties of the material can be selected by the user as necessary to enhance the finished properties of the metal being cast.

Having thus described our invention, what we desire to be secured by Letters Patent of the United States, is set forth in the appended claims.

We claim:

1. In a metallurgical side board having a generally parallelepiped shape and rectangular cross-section with a first face of said board adapted to be placed adjacent a wall of an ingot mold thus exposing a second face to molten metal teemed into said ingot mold the improvement comprising:

at least two generally parallel vertically spaced apart apertures in said board extending through said board from said first face to said second face;

a generally perpendicular passage between said apertures, said passage opening only onto said first face of said board; and a hanger having a first section rotatably embedded in said board and extending the length of said passage; said hanger extending out of said board and having a second section at the end of said first section projecting beyond said board disposed at a right angle to said first section of said hanger; a third section of said hanger disposed at a right angle to said first section of said hanger, said third section being positioned with respect to said first section and of a size to be within and alternately engage the apertures in said board; said first, second and third sections of said hanger lying within the same plane; said second section adapted to position said hanger on an ingot mold and said first and third sections of said hanger supporting said board in operative position in said ingot mold;

whereby said hanger can be disposed with all sections co-planar with said board for fabrication, packaging, and shipping and readily moved to support said board in an operative position in said ingot mold.

2. A combination according to claim 1 wherein said hanger is an elongated rod.

3. A combination according to claim 2 wherein said second section of said rod defines a hook adapted to engage the upper edge of an ingot mold.

4. A combination according to claim 1 wherein said second section of said hanger defines a hook to securely engage the ingot mold wall.

5. A combination according to claim 1 wherein there are additional apertures disposed parallel to and vertically from said apertures all of said apertures communicating with a generally perpendicular passage opening only onto said first face of said board.

6. A combination according to claim 1 wherein said board has shaped edges so that four boards can be placed within an ingot mold thus defining a closed reservoir.

7. A combination according to claim 1 wherein the board is elongated having a pair of apertures and associated hanger at two locations in said board to cooperatively support said board in an ingot mold.

8. A combination according to claim 1 wherein said hangers are rods having second sections defining hooks.

9. In a metallurgical hot top adapted to be placed in the top of an ingot mold and having four walls defining an open ended reservoir within said ingot mold each of said walls having a first face to be positioned adjacent a wall of said mold and a second face adapted to contact molten teemed into said ingot mold the improvement comprising:

at least two generally parallel vertically spaced apart apertures in each of said walls extending through said walls from said first face to said second face;

a generally perpendicular passage between said apertures, said passage opening only onto said first face of said walls; and a hanger having a first section rotably embedded in each of said walls and extending the length of said passage; each of said hangers extending out of the wall in which it is embedded, and having a second section at the end of said first section projecting beyond said wall disposed at a right angle to said first section of said hanger; a third section of said hanger disposed at a right angle to said first section of said hanger, said third section being positioned with respect to said first section and of a size to be within and alternately engaged the apertures in said wall in which it is embedded; said first, second and third sections of said hanger lying within the same plane; said second section adapted to position said hanger on an ingot mold and said first and third sections of said hangers supporting said hot top in operative position in said ingot mold;

whereby said hangers can be disposed with all sections co-planar with the wall within which it is embedded for fabrication, packaging and shipping, and readily moved to support said hot top in an operative position in said ingot mold.

10. A combination according to claim 9 wherein said apertures are elongated slots, the long dimension of the slot disposed generally parallel to the ends of the hot top.

* * * * *